US006353170B1

(12) United States Patent
Eyzaguirre et al.

(10) Patent No.: US 6,353,170 B1
(45) Date of Patent: Mar. 5, 2002

(54) METHOD AND SYSTEM FOR COMPOSING ELECTRONIC MUSIC AND GENERATING GRAPHICAL INFORMATION

(75) Inventors: Adriana Eyzaguirre, London (GB); Ole Ivanoff, Valby (DK)

(73) Assignee: INTERLEGO AG, Baar (CH)

( * ) Notice: Subject to any disclaimer, the term of this patent is extended or adjusted under 35 U.S.C. 154(b) by 0 days.

(21) Appl. No.: 09/763,906

(22) PCT Filed: Sep. 3, 1999

(86) PCT No.: PCT/IB99/01655

§ 371 Date: Apr. 26, 2001

§ 102(e) Date: Apr. 26, 2001

(87) PCT Pub. No.: WO00/14719

PCT Pub. Date: Mar. 16, 2000

Related U.S. Application Data

(63) Continuation of application No. PCT/IB99/01655, filed on Sep. 3, 1999.

(60) Provisional application No. 60/099,290, filed on Sep. 4, 1998.

(51) Int. Cl.[7] ..... G10H 7/00

(52) U.S. Cl. ..... 84/603; 84/464 R; 345/302; 345/474

(58) Field of Search ..... 84/600, 603, 464 R; 707/104; 345/302, 473, 474, 116, 949

(56) References Cited

U.S. PATENT DOCUMENTS 5,005,459 A 4/1991 Adachi et al.
5,430,835 A * 7/1995 Williams et al.
5,496,962 A 3/1996 Meier et al.
5,679,913 A 10/1997 Bruti et al.
5,801,694 A * 9/1998 Gershen
5,824,933 A * 10/1998 Gabriel
5,864,868 A * 1/1999 Contois ..... 707/104
5,915,288 A * 6/1999 Gabriel ..... 84/743 X
5,952,598 A * 9/1999 Goede ..... 84/603 X
6,084,590 A * 7/2000 Robotham et al. ..... 345/473 X
6,115,053 A * 9/2000 Perlin ..... 345/473 X

FOREIGN PATENT DOCUMENTS

GB 2 209 425 5/1989
WO WO 97-21210 6/1997

* cited by examiner

*Primary Examiner*—Jeffrey Donels
(74) *Attorney, Agent, or Firm*—Pitney, Hardin, Kipp & Szuch LLP

(57) ABSTRACT

A method and system are provided that allows a user to interactively compose music and create a video of an animated character that dances to the rhythm and beat of the composed music. To compose music, the user interactively selects and arranges a plurality of music samples for a plurality of instruments. Music samples are independent pieces of music that can be seamlessly looped to compose the musical work. A harmonizer program allows the user to hammonize the music samples that play simultaneously, thereby allowing the user to compose a music piece without knowledge or experience in musical theory or training. The user creates a video of an animated character that dances to the rhythm and beat of the music using an animation program. The animation program provides the user with a plurality of video clips from which the user can select and arrange to create the video. Once completed, the user can play, edit, and save the composed music and the video.

12 Claims, 8 Drawing Sheets

METHOD AND SYSTEM FOR COMPOSING ELECTRONIC MUSIC AND GENERATING GRAPHICAL INFORMATION

CROSS-REFERENCE TO RELATED APPLICATIONS

This application is a 371 of PCT/IB99/01655 filed Sep. 3, 1999 and also claims the benefit of U.S. Provisional Application No. 60/099,290, filed Sep. 4, 1998, the contents of which are hereby incorporated by reference.

FIELD OF THE INVENTION

The present invention relates generally to interactive computer technology and, more particularly, to a method and system using a computer to electronically compose music and generate corresponding graphical animation.

BACKGROUND OF THE INVENTION

The composition of music is usually restricted to those individuals with musical talent or, at a minimum, an understanding of music. Without one or the other, an individual will usually find it difficult to compose music successfully when measured by a common yardstick of taste. Thus, the widespread use of computers, while providing a wide variety of tools to the expert musician, has done little to open doors for the musically unsophisticated to experience the joy of creating music. For example, software programs exist that allow a musician to compose, record, play back, and print music in various ways. These programs use, for example, digital audio and Musical Instruments Digital Interface (MIDI) that allow a musician to hear music the second it is created, access a near infinite variety of musical instruments, and make major changes to a composition with little effort. The problem with these tools is that the user must still bring an understanding of music and/or talent into the process to create something that will satisfy oneself or others.

One solution allows those with little musical experience and sophistication to interact with a previously composed musical work. An example is described in U.S. Pat. No. 5,801,694. This patent discloses a method in which a musical expert reduces a pre-existing musical work into its elements such as, for example, a solo track and accompanying tracks to create a musical template. These tracks are then stored in a database. Additional solo and accompanying tracks may be composed by the expert musician and also stored in the database. The musically unsophisticated user can then construct a new arrangement of the existing musical work by selecting various tracks from the database and allocating the tracks to fixed positions in the template. The template allows a user to rearrange, for example, pieces of the accompanying track while preserving the underlying structure of the musical work composed by the expert musician.

This method, however, provides too much structure for an unsophisticated user interested in composing a unique musical work. It restricts the creative process to selecting pieces from an expert musician's pre-composed tracks and placing them in positions defined by the expert musician's template.

U.S. Pat. 5,679,913 discloses an electronic apparatus for automatic composition and reproduction of musical works. The electronic apparatus comprises means for reading data of musical events on data tracks and make the temporal lengths of selected data tracks uniform and to synchronize in real time the reading of data tracks having equal or different length. This document is considered with composition and reproduction of music only.

WO 97/21210 discloses a method and apparatus for interactively creating musical compositions based on a database with musical sequences and a template comprising a plurality of sequence positions. Using a menu-driven, graphical interface utilizing icons and images, a user interactively selects a plurality of the fixed musical sequences, and allocates the selected sequences among the various fixed sequence positions specified by the template. The result of this interactive selection procedure is a musical composition that can be played. This document is also considered with composition and reproduction of music only, despite a graphical user interface is employed in the creating and playing of music.

U.S. Pat. 5,005,459 discloses a musical tone visualising apparatus including an image memory for storing plural images relating to players or musical instruments of an orchestra, a display unit for displaying the images on a display screen thereof and a display control circuit for controlling the display unit so that displayed images can be varied in response to an inputted musical tone signal or inputted performance information outputted from an electronic instrument. Thereby, the displayed images can be automatically varied in response to the performance of the electronic musical instrument.

In light of the foregoing, there is a need for a method and system that allows a musically unsophisticated user to experience the joy of composing music.

SUMMARY OF THE INVENTION

Accordingly, the present invention is directed to a method for using a computer to compose a musical work and create a video of an animated character. The present invention includes the steps of interactively selecting a music sample from a plurality of music samples, wherein each of the music samples is an independent pre-composed piece of music of fixed duration. A user then, interactively places the selected music sample in a location in the musical work, and interactively repeats the step of selecting a music sample and placing the selected music sample in a location in the musical work, as desired by the user, to create the musical work.

In another aspect, the invention includes a method for using a computer to compose a musical work for a plurality of instruments including the steps of interactively selecting one of a plurality of musical instruments, interactively selecting one of a plurality of music samples, wherein each of the music samples is an independent pre-composed piece of music. A user then sequentially arranges the selected music samples. The user then interactively selects another one of the plurality of musical instruments and interactively repeats the steps of selecting a plurality of music samples and sequentially arranging the selected music samples for another one of the plurality of musical instruments. Next, the user interactively selects one of the music samples previously arranged and interactively harmonizes the arranged music samples of all instruments that correspond in time to the selected music samples. The user interactively repeats the step of selecting one of the music samples previously arranged, and harmonizing the arranged music samples of all instruments that correspond in time to the selected music sample previously arranged to compose the musical work.

In another aspect, the invention includes a system for composing a musical work comprising a central processing unit, a video display, an input device, a general memory, means for interactively selecting a plurality of the music samples, interactively arranging the selected music samples in a serial manner for a plurality of instruments, and interactively selecting the music samples to be harmonized, as desired by the user, and means for playing the musical work. The general memory stores a plurality of music samples, wherein each of the music samples is an independent pre-composed piece of music, a harmonizer program that harmonizes the music samples selected and arranged by a user, and a program that facilitates composition of the music.

The accompanying drawings are included to provide a further understanding of the invention and are incorporated in and constitute a part of this specification, illustrate several embodiments of the invention and together with the description serve to explain the principles of the invention.

BRIEF DESCRIPTION OF THE DRAWINGS

The accompanying drawings, which are incorporated in and constitute a part of this specification, illustrate an embodiment of the invention and, together with the description, serve to explain the objects, advantages, and principles of the invention.

DETAILED DESCRIPTION OF THE PREFERRED EMBODIMENTS

Reference will now be made in detail to the preferred embodiments of the invention, examples of which are illustrated in the accompanying drawings.

Figure 1:
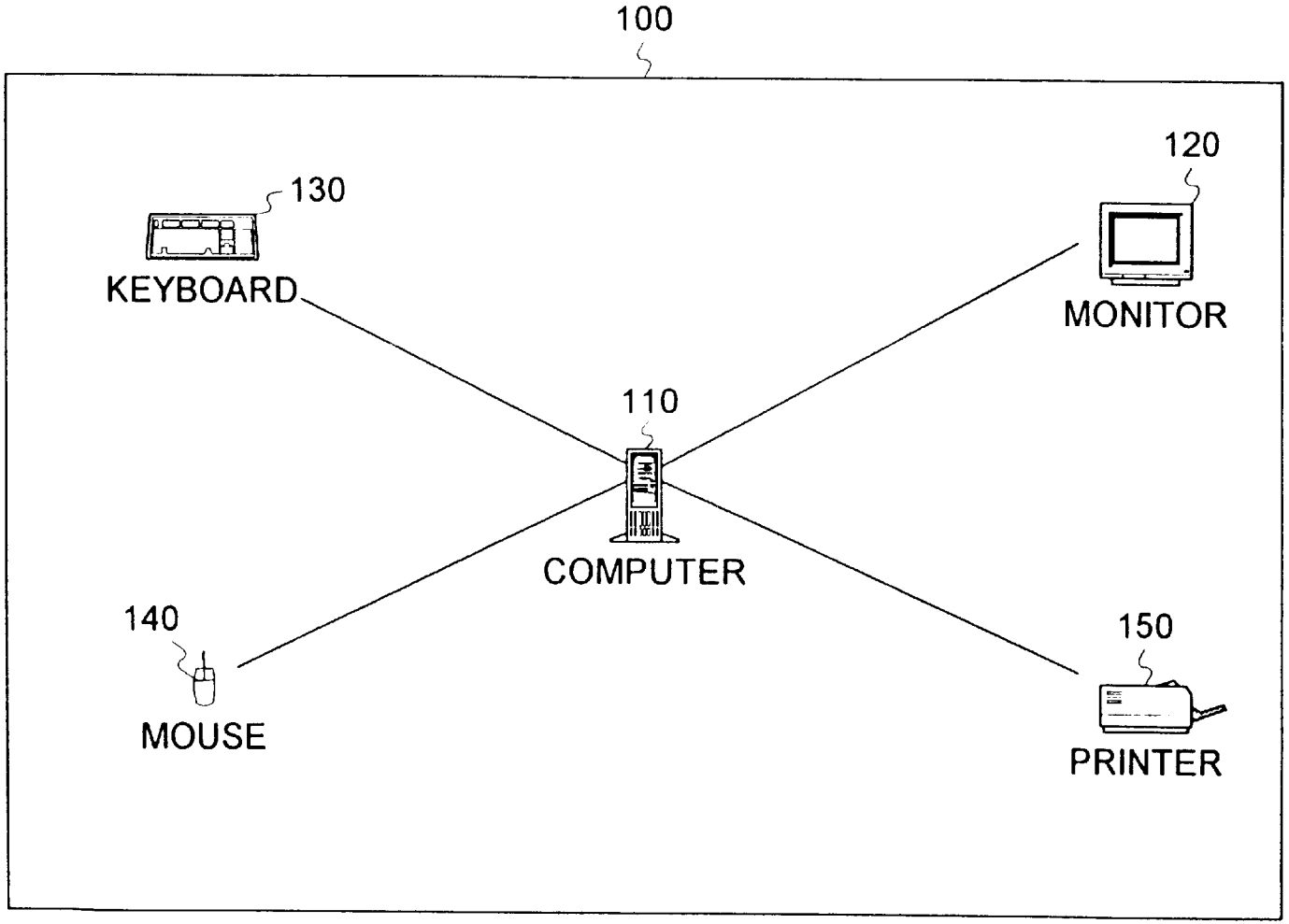
FIG. 1 is a diagram of a system according to an embodiment consistent with the present invention.

FIG. 1 is a diagram of a system according to an embodiment consistent with the present invention. A system 100 includes a computer 110 connected to a monitor 120, a keyboard 130, a mouse 140, and a printer 150. In the preferred embodiment, computer 110 is a multimedia system having audio-visual capabilities. The present invention, however, may be implemented in any computer platform with sufficient processing and memory capacity to perform the processes described below.

Figure 2:
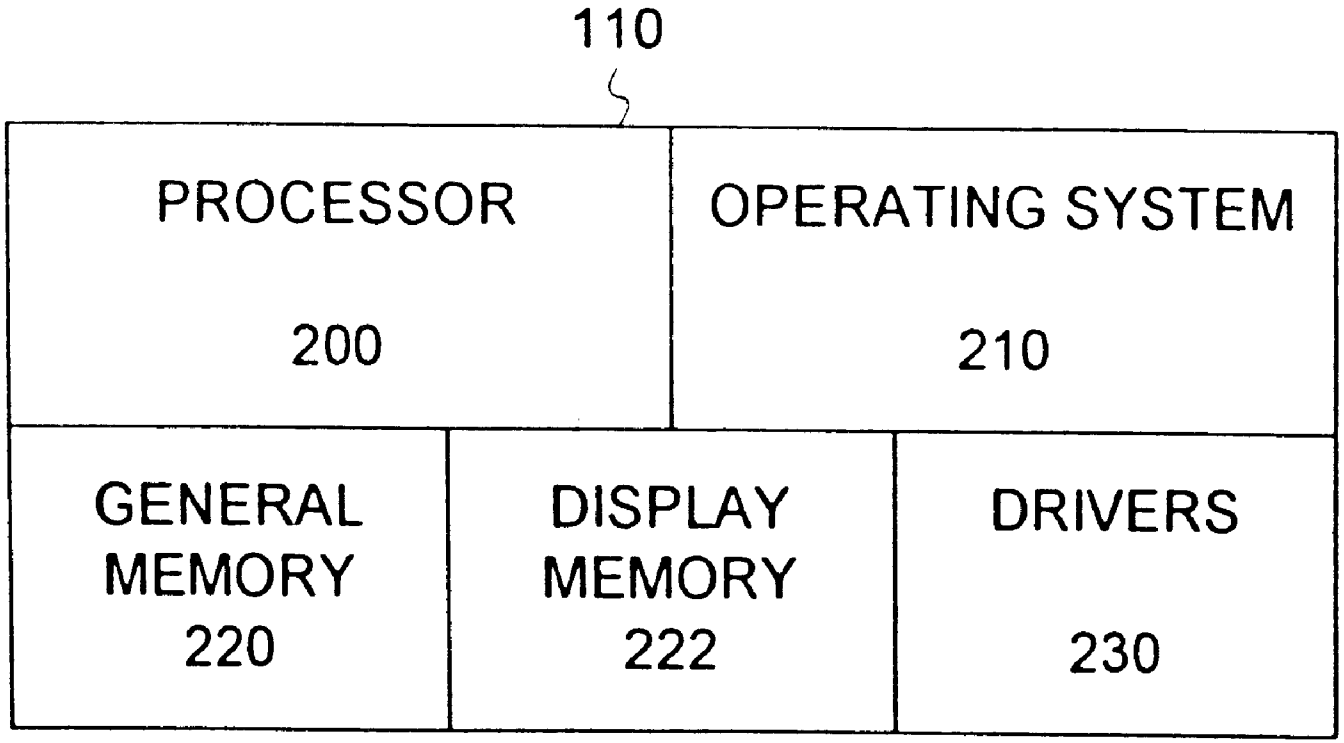
FIG. 2 is a schematic diagram illustrating components of a device according to an embodiment of the present invention.

FIG. 2 is a schematic diagram illustrating in detail components of computer 110. A processor 200 operates on an operating system 210, which may be any operating system including Windows, DOS, MacOS, SONY Playstation OS, Nintendo OS, OS2, and Linux. Computer 110 contains RAM composed of a general memory 220 and a display memory 222. Drivers 230 control various input and output devices connected to computer 110.

Figure 3:
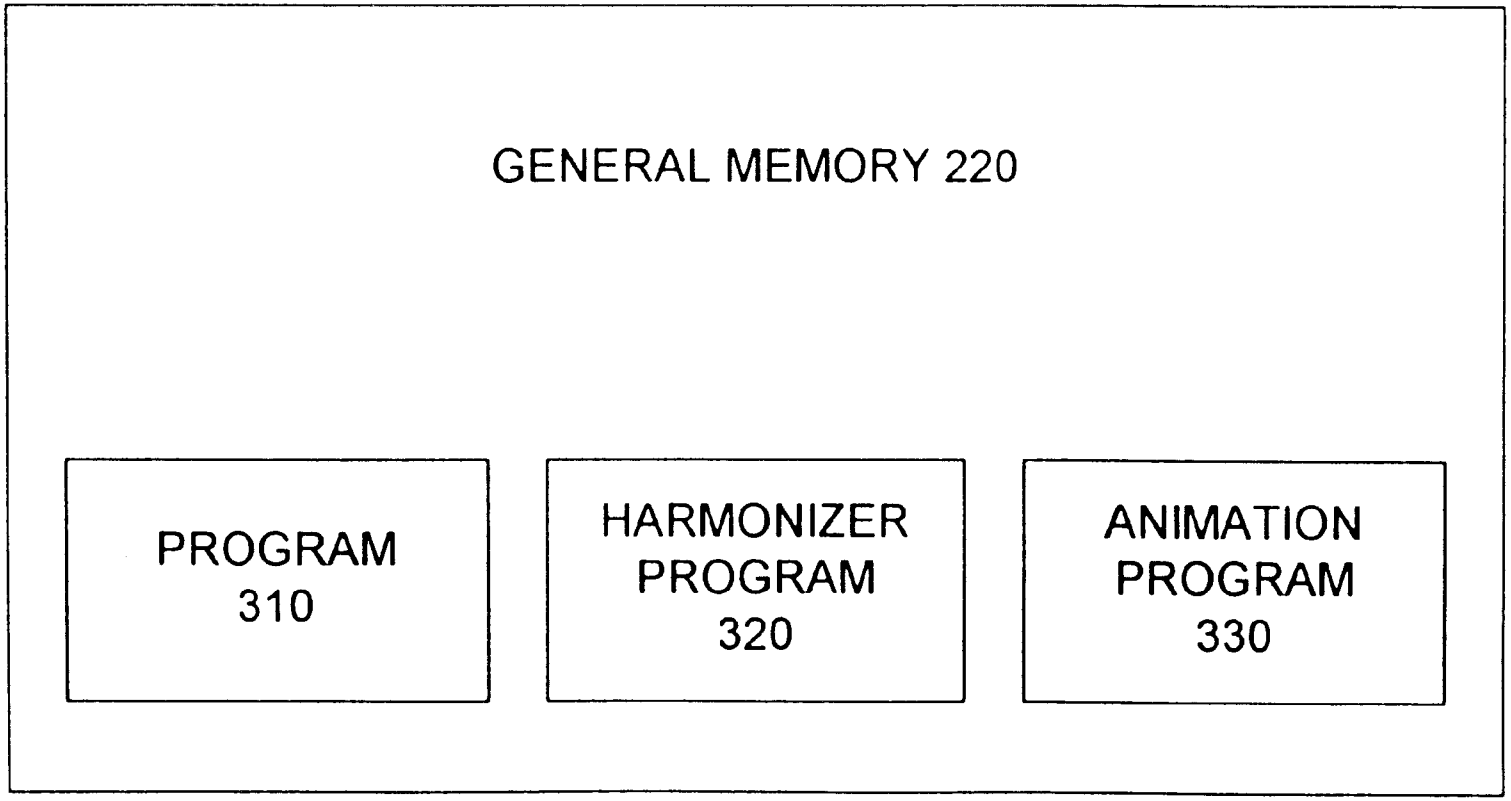
FIG. 3 is a block diagram illustrating the components of the general memory of a system according to one embodiment of the present invention.

FIG. 3 is a block diagram illustrating the components of general memory 220 according to one embodiment of the present invention, which includes a program 310, a harmonizer program 320, and an animation program 330. Program 310 is a main program overseeing the operation of system 100. Harmonizer program 320 harmonizes musical instruments for musical composition. Animation program 330 facilitates movements of a graphical animation figure according to a musical piece. Programs 310, 320, and 330 may be written in languages such as C, C++, Be, Linux, Basic, VisualBasic, or Macromedia Director.

Figure 4:
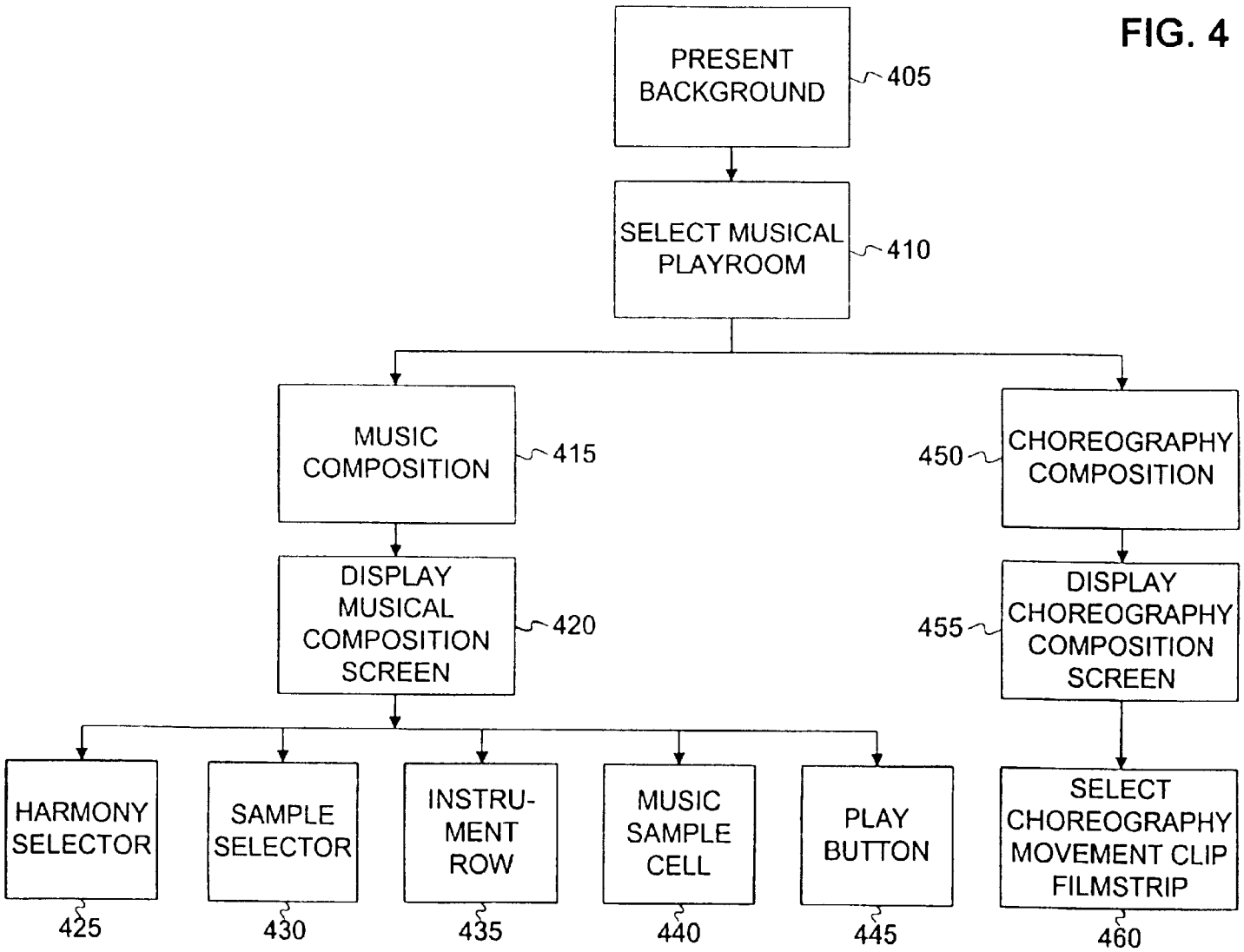
FIG. 4 is a flowchart illustrating the process of the program that facilitates composing music and creating a video according to one embodiment of the present invention.
Figure 6:
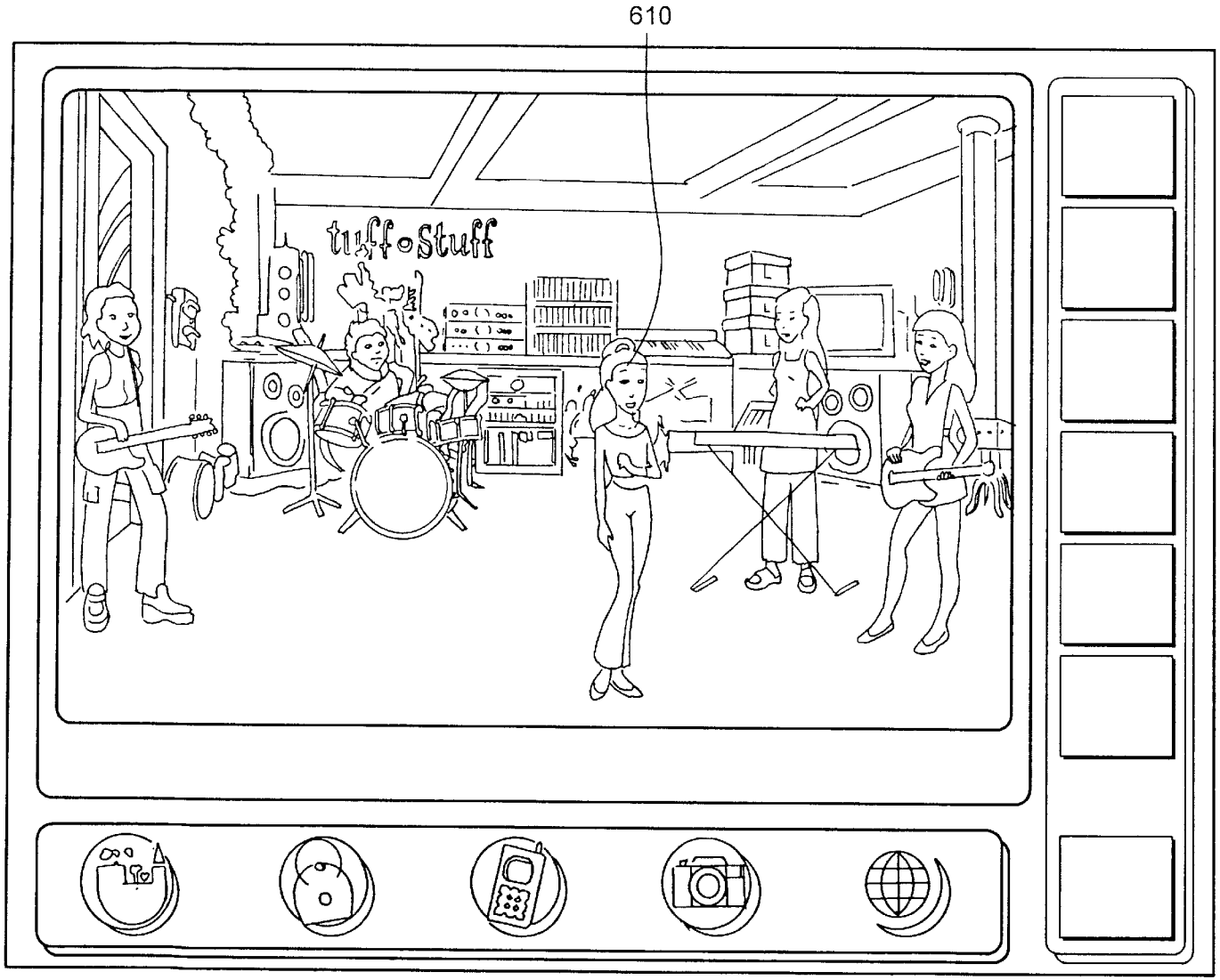
FIG. 6 shows an image of the music composition screen according to one embodiment of the present invention.

FIG. 4 is a flowchart illustrating the overall process of system 100 according to one embodiment of the present invention. The process of system 100 may be implemented, for example, as a story to add entertainment value and enhance ease of use. Program 310 may first introduce the background and characters of the story to the user (step 405). Program 310 displays, for example, a background image, and in a multimedia system, also provides an audio narration. Program 310 also presents several options the user may select from. One option includes a musical playroom icon. If the user selects musical playroom icon (step 410), program 310 displays a musical playroom with musicians and musical instruments as shown in FIG. 6.

Figure 7:
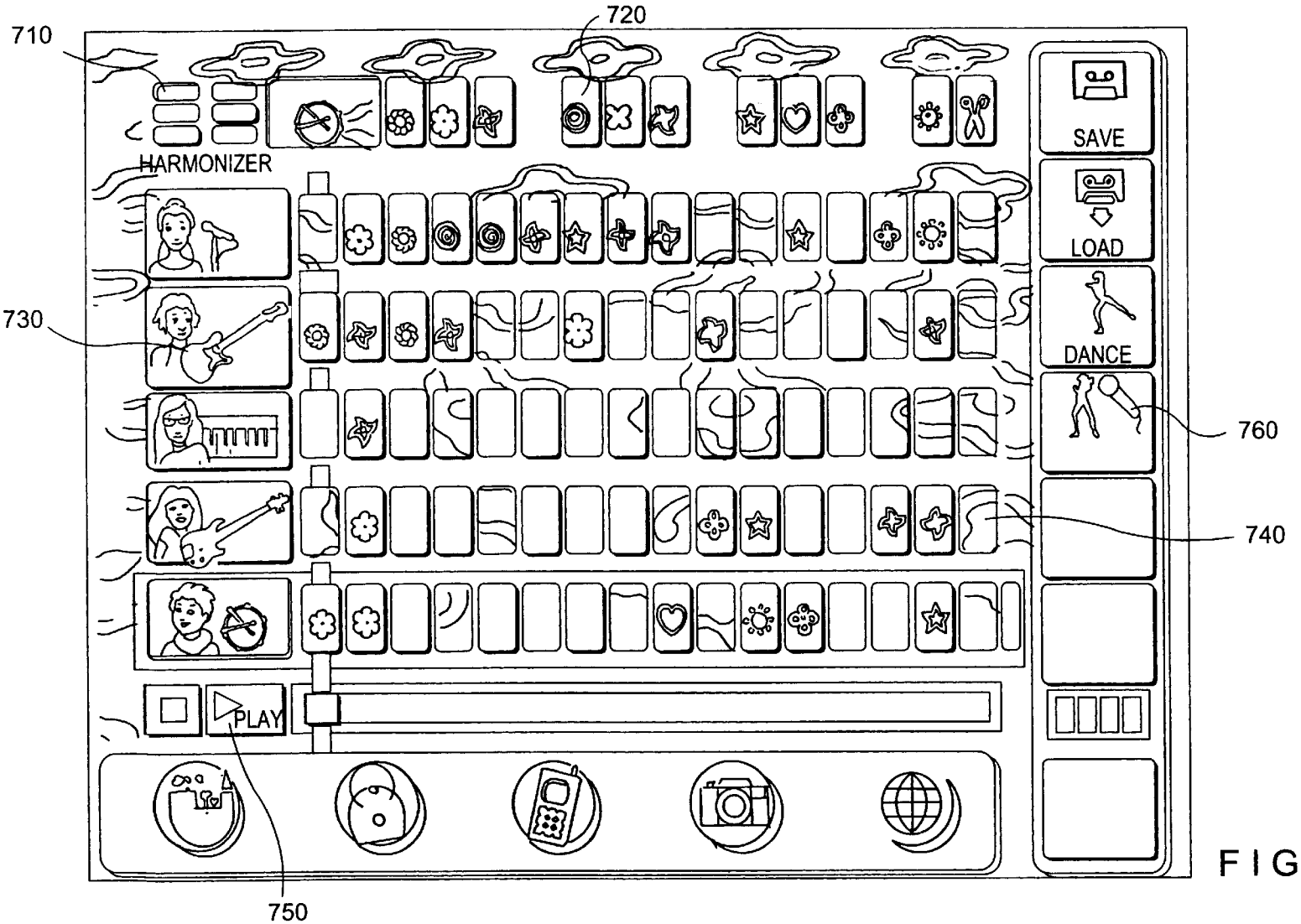
FIG. 7 shows the video composition screen according to one embodiment of the present invention.

In an embodiment consistent with the present invention, the user selects any of the displayed musical instruments to compose music. When the user selects one of the instruments, for example, by clicking mouse 140 on that instrument (step 415), program 310 displays a musical composition screen as shown in FIG. 7 (step 420). At this point, the user is free to compose a musical piece using a harmony selector 710, a sample selector 720, and an instrument row 730.

Specifically, sample selector 720 allows the user to choose a sample in a certain style and apply it to the music by clicking and dropping it in the desired place in the work (step 430). Music samples are independent pieces of music composed by a musician and stored in memory. In a preferred embodiment, each sample is one measure long. Each music bar is composed with a similar interface so that it can be seamlessly looped to each of the other music bars. This allows any music bar to be played sequentially with any other music bar without a listener being able to distinguish the interface or hearing an abrupt break in the music. In other words, the seamlessly looped music bars sound pleasing to the listener when one is played after another.

Instrument row 730 displays the musical instrument selected for that row (step 435). In an embodiment consistent with the present invention, the user may select and change the instrument of instrument row 730. Each instrument row has, for example, sixteen spaces for the user to place selected music samples, corresponding to the standard sixteen measure length of western music. A music sample cell 740 shows graphically the sample the user has selected, if any, to be played by the instrument in the corresponding instrument row 730 at that given point and time in the composition. In a preferred embodiment, the memory stores a version of each sample played by each instrument. In an altemative embodiment, however, the samples can be "played" by different instruments by using, for example, a synthesizer to generate the sound of the selected instruments.

Music sample cell 740 also indicates the harmony for a particular column since all samples in the same column have the same harmony as described below in connection with harmony selector 710 (step 440). The user may delete a particular sample during composition, and insert instead a bar of silence. A play button 750 activates program 310 to mix the composed music and play the music (step 445). Accordingly, system 110 facilitates music composition by mixing the content of the different cells together to a piece of music, i.e., "folding" the columns and setting the rows in sequence, thereby assembling all different pieces to one single track, which can be saved, edited, and played. Thus, system 100, through harmonizer program 320, ensures a harmonic piece of music.

Harmony selector 710 allows the user to choose a harmony for each column of instruments, thereby "harmonizing" all instruments shown in corresponding instrument row 730 (step 425). For example, if the user chooses the bass instrument (or any other) and then selects harmony selector 710, harmonizer program 320 aligns all instruments to the selected harmony. In doing so, harmonizer program 320 drops off "disharmonies," which may be defined, for example, as harmonies outside western tonality and pop harmonies, and aligns the instruments automatically. Thus, harmony selector 710 allows the user to compose a music piece without knowledge or experience in musical theory or training.

In an embodiment consistent with the present invention, system 110 stores a version of each music sample in a plurality of harmonies. Harmony selector 710 allows the user to select from, for example, six different harmonies for each music sample. A user selects a harmony for each column of instruments by selecting the desired column and selecting a harmony from harmony selector 710. Alternatively, a user can place music samples, as desired, and harmonizer program 310 will harmonize a column to the harmony of the last music sample placed in the column. Harmonizer program 310 does so by retrieving the version of the music samples in the column with the harmony corresponding to the harmony of the last music sample placed in the column.

In another embodiment, the harmonizer program 310 may be software that analyzes the harmony of the selected music samples. In this embodiment, system 110 stores only one version of each music sample. The harmonizer program 310 transposes the music samples in each column to match the harmony selected by the user by changing, for example, the pitch of the music samples.

Program 310, harmonizer program 320, and animation program 330 allow a user to compose a new musical work following any procedure the user desires. A user at the music composition screen shown in FIG. 7 could, for example, choose an instrument 730, select a plurality of music samples 720, and arrange them in the chosen instruments instrument row 740, as desired. The user could also, for example, select a music sample and place the selected music sample in any space of any instrument's instrument row. Selection and placement of music samples in this manner can continue, as the user desires, until all spaces for all instruments are filled or until the user has determined that the musical work is complete. Harmonization of each of the columns of instruments may be done at any time using harmonizer buttons 710. Program 310 allows the user to save, edit, and play the music at any time during the process.

Figure 8:
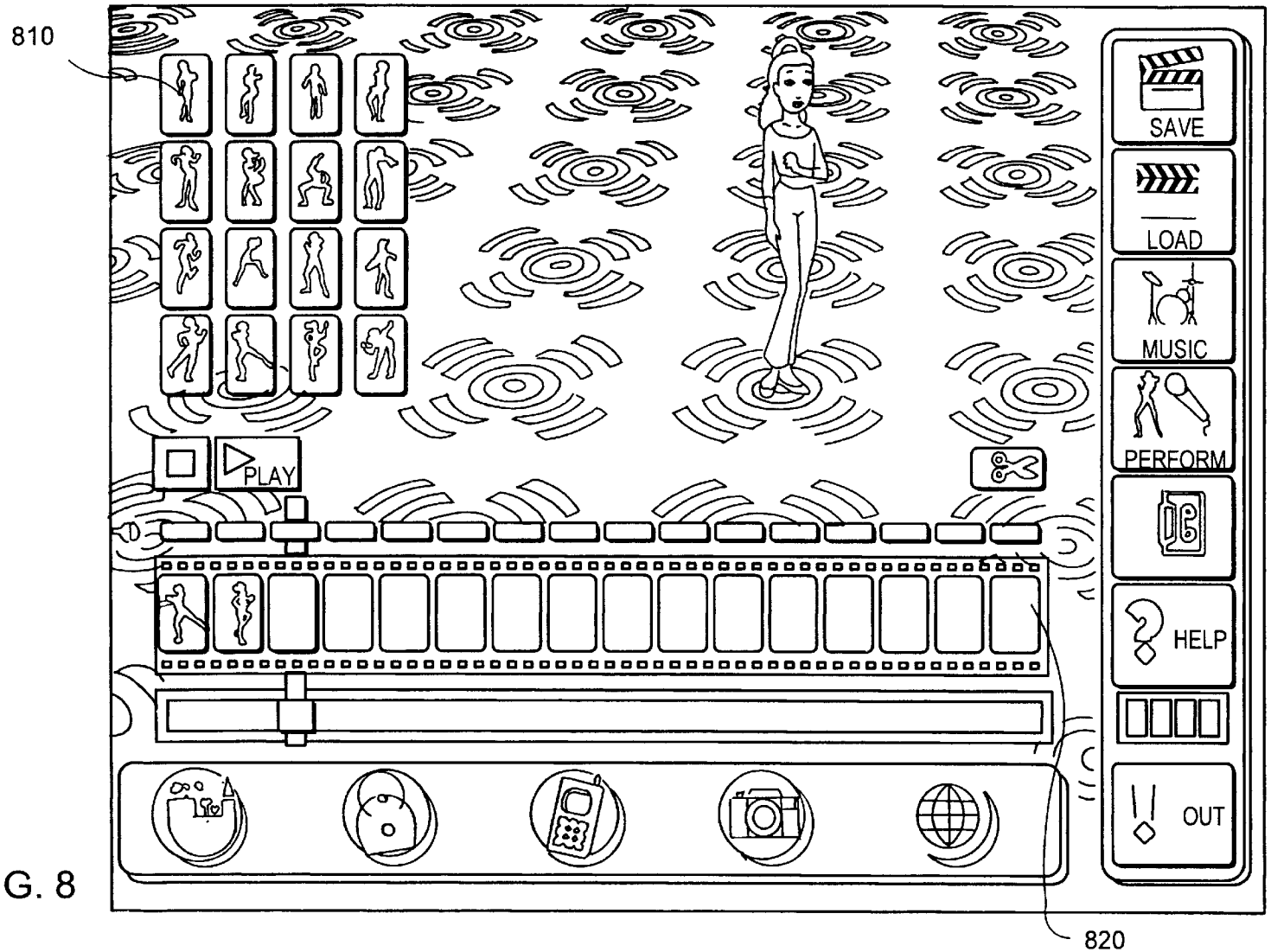
FIG. 8 shows an image of the band performing music composed by a user according to one embodiment of the present invention.

Program 310 also provides an option to the user to create a video character that dances to the composed music (step 450). If the user clicks on video character 610 (FIG. 6), for example, program 310 presents a choreography composition screen of FIG. 8 (step 455). From this screen, the user may select a choreography movement selector 810 containing a plurality of pre-drawn dance movement clips. The user may select the desired dance movement clip and drop it in a desired cell in a filmstrip 820 (step 460). Accordingly, when the user plays the composed music, animation program 330 produces an animation character 610 that dances by sequentially displaying the dance movement clips of filmstrip 820 at corresponding speed and tempo of the music. In an embodiment consistent with the present invention, the animated dancer corresponds to the character of the lead singer.

System 100 enables the user to freely combine dance moves to a piece of music. Although one skilled in the art may design animation program 330 to any musical beat, in one embodiment consistent with the present invention, the video character matches a beat of 120 bpm (beats per minute). The choreography movement images are preferably pre-drawn, although the user may elect to modify or create customized images. Animation program 330 enables the movements of the video character to automatically adjust to the music as one image interleaves smoothly with the following image regardless of which movement clips are selected. Program 310 also enables the user to save, load, or edit filmstrip 820 containing the selected movement clips.

Figure 5:
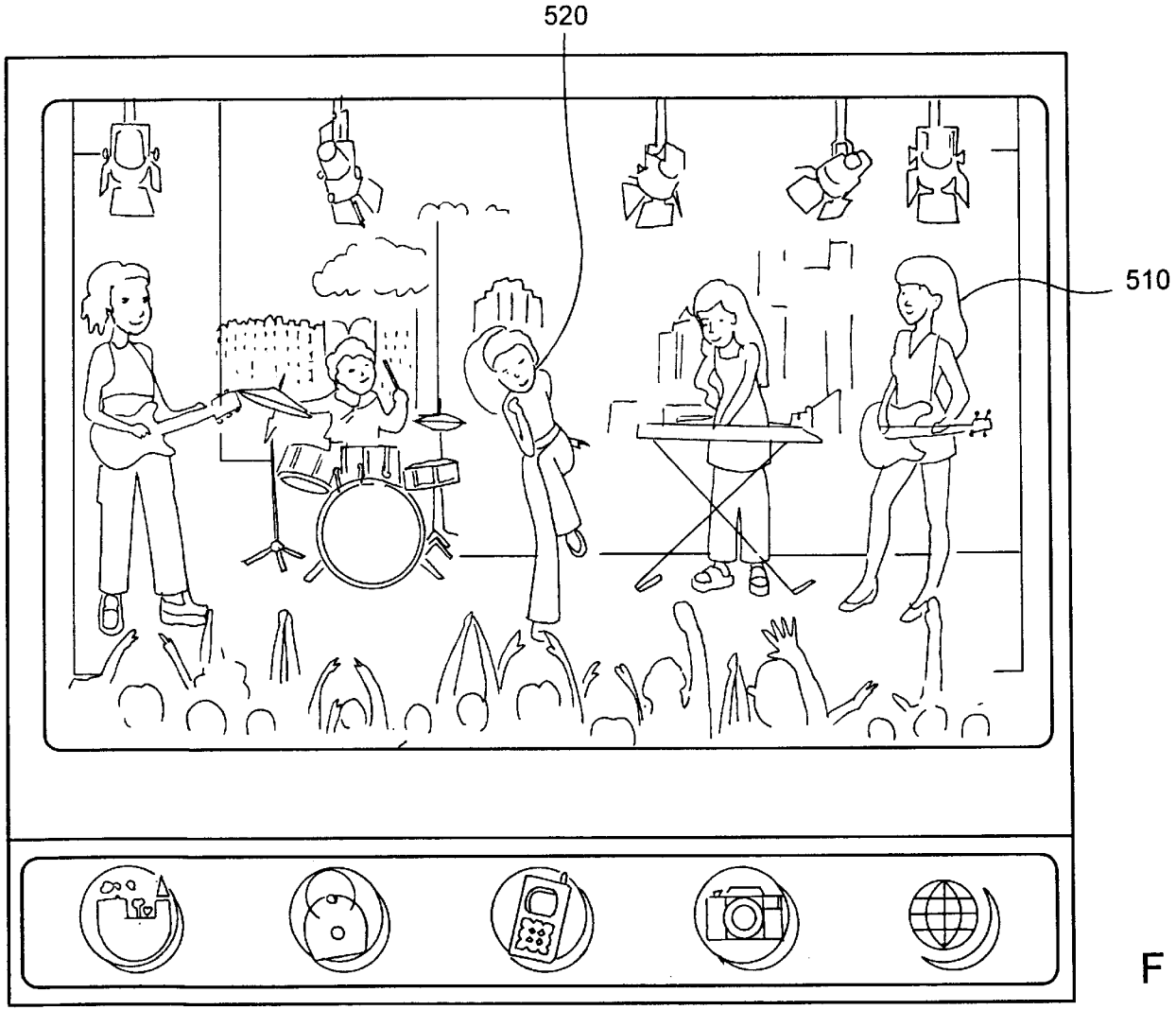
FIG. 5 shows an image of a musical playroom according to one embodiment of the present invention.

Once a user has composed a musical work and combined dance moves for the animated character, performance button 760 allows the user to combine the musical work and the dancing animated character. In an embodiment consistent with the present invention, the music is "played" by a band. As shown in FIG. 5, each instrument is played by a character in the band 510 and the lead singer 520 is the animated character that dances to the beat of the music.

It will be apparent to those skilled in the art that various modifications and variations can be made in the method and system of the present invention without departing from the spirit or scope of the invention. Thus, it is intended that the present invention cover the modifications and variations of this invention provided they come within the scope of the appended claims and their equivalents.

What is claimed is:

1. In a computer, a method of composing a multimedia work comprising the steps of:

in response to a user interaction selecting (430) a music sample from a plurality of music samples, wherein each of the music samples is an independent pre-composed piece of music of fixed duration having a common interface that allows the music samples to be seamlessly looped; and placing (740) the selected music sample in a location in the multimedia work, wherein the step of selecting (430) a music sample and placing (740) the selected music sample in a location in the multimedia work is repeated in response to a user interaction to create the multimedia work characterized in that the method further comprises the steps of:

in response to further user interaction selecting (460) a pre-drawn dance movement clip from a plurality of dance movement clips; and placing the selected pre-drawn dance movement clip (810) in a location (820) in the multimedia work; wherein the step of selecting a pre-drawn dance movement clip and placing the selected pre-drawn dance movement in a location (820) in the multimedia work is repeated in response to further user interaction to create the multimedia work as a user composed multimedia work with an animated character (610) that dances to a user created composition of the musical samples by playing (750) the selected music samples and sequentially displaying (FIG. 6) the dance movement clips at corresponding speed and tempo of the music.

2. The method of claim 1, further including a step of removing a selected music sample to insert a sample of silence.

3. The method of claim 1, wherein a video is interactively created from a plurality of video clips and said video is synchronized to a beat of the musical work.

4. The method of claim 1, wherein the step of selecting a music sample comprises the steps of:

selecting one of a plurality of musical instruments;

selecting one of a plurality of music samples for the selected instrument, wherein each of the music samples is an independent pre-composed piece of music, and sequentially arranging the selected music sample; and selecting another one of the plurality of musical instruments, repeating the steps of selecting a plurality of music samples and sequentially arranging the selected music samples for said another one of the plurality of musical instruments.

5. The method of claim 4, further comprising the steps of:

selecting one of the music samples previously arranged, harmonizing the arranged music samples of all instruments that correspond in Uime to said selected one of the music samples previously arranged; and repeating the step of selecting one of the music samples previously arranged, and harmonizing the arranged music samples of all instruments that correspond in time to said selected one of the music samples previously arranged to compose the musical work.

6. The method of claim 1, wherein the steps are performed in response to user interactions using a graphical user interface.

7. The method of claim 1, further including the steps of:

storing a version of the plurality of music samples for each of the specified instruments.

8. The method of claim 1, wherein video of a dancer is choreographed to the musical work so that movements of the dancer match a beat of the musical work.

9. The method of claim 1, wherein the video of the dancer is choreographed to match 120 beats per minute.

10. The method of claim 1, wherein the interactive steps are implemented using a story.

11. The method of claim 1, wherein the music samples are one measure long.

12. A computer system comprising means for executing the method according to any of the claims 1 through 11.

* * * * *